US006423397B1

(12) United States Patent
Roussel

(10) Patent No.: US 6,423,397 B1
(45) Date of Patent: Jul. 23, 2002

(54) EMBOSSED ABSORBENT PAPER SHEET

(75) Inventor: Gilles Roussel, Colmar (FR)

(73) Assignee: Georgia-Pacific France, Kunheim (FR)

( * ) Notice: Subject to any disclaimer, the term of this patent is extended or adjusted under 35 U.S.C. 154(b) by 0 days.

(21) Appl. No.: 09/673,848

(22) PCT Filed: Apr. 23, 1999

(86) PCT No.: PCT/FR99/00972

§ 371 (c)(1),
(2), (4) Date: Nov. 16, 2000

(87) PCT Pub. No.: WO99/55967

PCT Pub. Date: Nov. 4, 1999

(30) Foreign Application Priority Data

Apr. 24, 1998 (FR) ..... 98 05147

(51) Int. Cl.[7] ..... B32B 3/00

(52) U.S. Cl. ..... 428/156; 428/153; 428/154; 428/166; 428/172; 162/109

(58) Field of Search ..... 428/153, 154, 428/156, 166, 172, 165, 212, 906; 162/109, 123

(56) References Cited

U.S. PATENT DOCUMENTS

| | | | | |
|---|---|---|---|---|
| 3,414,459 A | * | 12/1968 | Evans | 428/156 |
| 5,328,565 A | * | 7/1994 | Rasch et al. | 162/113 |
| 5,458,950 A | * | 10/1995 | Bredenick et al. | 428/154 |
| 5,620,776 A | * | 4/1997 | Schulz | 428/156 |

* cited by examiner

*Primary Examiner*—Donald J. Loney
(74) *Attorney, Agent, or Firm*—Breiner & Breiner, L.L.C.

(57) ABSTRACT

The invention concerns a web of absorbent paper, in particular of cellulose cotton, including on one side protrusions of which the top surfaces are less than 1 $mm^2$ each and which correspond to cavities on the other side, the web being characterized in that the protrusions are distributed at a rate of more than 30/$cm^2$ along mutually parallel lines in a manner such as to bound cells of which the total surface takes up at least 30% of the web surface, the cells per se being unembossed or embossed only slightly.

11 Claims, 2 Drawing Sheets

EMBOSSED ABSORBENT PAPER SHEET

The present invention relates to absorbent papers for sanitary or household use and its objective is a web composed of at least one embossed ply to make toilet paper foremost, but also handkerchiefs, napkins or paper towels.

In order to manufacture this kind of paper, the sanitary and household paper industry uses absorbent paper which generally is creped and of low weight density, called cellulose wadding or cotton wool fabric. The structure's stretchability, for example, imparted by creping, is used to emboss the web. This processing permanently deforms the web between an undeforming cylinder having a topology of salients and a mating cylinder, illustratively, coated with a resilient material. In this manner, protrusions are made on one side which correspond to cavities on the other side.

The trend in recent years for sanitary products made of cellulose wadding has been to make them softer, more velvety, by operating on their thickness and mechanical strength, in particular by embossing them. Embossing moreover allows improving product appearance. Embossing is carried out either on substantially wet paper, that is in the wet portion of the papermaking machine, or on low-moisture paper, when being mechanically worked. In that case, work is performed on a dry web unwound from a mother spool of the papermaking machine. The present invention concerns paper being worked in the dry part.

The most widely used embossing patterns are geometrically-based repeats of elementary protrusions of small cross-sections and simple geometric shapes. U.S. Pat. No. 3,414,459 illustratively describes a stratified web consisting of a plurality of elementary plies which are bonded to each other. The plies therein are embossed at a distribution rate and at a protrusion height designed for water-absorbing products, for example paper towels. The element density is from 5 to 30/cm$^2$. Applicant on its part has developed, in particular as regards toilet paper, patterns of which the element density is higher, ranging from 30 to 80/cm$^2$. Perforce the tops of these elementary surfaces are minute, each being less than 1 mm$^2$. Such products offer an appearance imitating that of a woven fabric. European Pat. No. 426 548 illustrates such an embodiment. This kind of embossing, which is fine and dense, is well suited to impart the appearance of thickness to the web.

However, its appearance is modest. Moreover, when two plies embossed in this manner are joined together, product softness is less than optimal.

French Patent Application No. 94 15196 offers a solution in improving the softness of a double-ply web made with this kind of embossing by using a joint pattern including a background pattern and a graphic pattern. The latter is composed of linear protrusions of a width between 0.1 and 2 mm and the former includes small and generally frusto-conical protrusions distributed at the rate of at least 30/cm$^2$. The plies are combined on the linear pattern, thereby limiting the surface of the mutually glued surfaces and the ensuing stiffness.

The background pattern protrusions must bring out the main pattern since they are not being easily seen with the naked eye on account of their inherent small size. However, during manufacture, the graphic pattern, which is salient on the cylinder, comes to rest against the rubber of the embossing cylinder just as do the teeth of the background pattern. Therefore the two kinds of embossing compete with each other. Due to their small size, the teeth of the background pattern are more effective in embossing than those of the graphic pattern and consequently the latter will leave a less defined imprint.

On the other hand, if a better defined graphic pattern is desired, the required embossing conditions will degrade the web properties, in particular its mechanical strength, both at the edges of the pattern itself and in the base texture. Another consequence is degradation of manufacturing conditions, for example degradation of the rubber coatings.

Furthermore, the proportion of the embossed surface of the background pattern is predominant, namely being 80% of the surface in practice. This feature ensures the main operational characteristics relating to embossing, namely thickness and absorption. During manufacture, the high pressure between the engraving and the mating rubber surface will be spread over a large number of elements. As a result, local stresses and the danger of tearing the web are reduced. Moreover, the pressure is applied substantially isotopically to the web, thereby limiting the danger of creating rupture paths.

Moreover, it is known that if the density is reduced, the stresses will be concentrated and the web is commensurately weakened.

The objective of the invention is a web of embossed absorbent paper offering a more elaborate pattern than a plain screen pattern without using linear protrusions.

Another object of the invention is to ensure homogeneous marking and good pattern definition.

Another objective of the invention is a two ply or three ply web of embossed absorbent paper of which the embossing pattern provides optimal preservation of flexibility following combination.

Another objective of the invention is a web of embossed absorbent paper with a thickness and mechanical strength roughly the same as in a web of which the embossing is uniformly distributed and uniformly higher than 30 protrusions/cm$^2$.

In the invention, a web made of absorbent paper, in particular of creped cotton wool and of a specific surface weight between 10 and 40 g/m$^2$ and including at one surface first protrusions having a peak area less than 1 mm$^2$ and corresponding to cavities on the other surface, is characterized in that the protrusions are distributed at a rate of at least 30/cm$^2$ along mutually parallel lines in a manner such as to bound cells of which the total surface takes up at least 30%, preferably at least 50%, of the web surface, these cells per se being embossed little or not at all.

A cell is a portion of the web surface enclosed by parallel lines subtended by the first protrusions and themselves including 30% of untextured zones. The cell shapes are arbitrary, though preferably they are geometric. The lines defining them may mutually cross to subtend grids, although the cells also may be disjointed.

Surprisingly, it was discovered that a web with embossing so defined offers the same thickness and mechanical strength as a web having an embossing composed of the same elements uniformly distributed over its surface at a higher uniform density. This feature is especially significant when making a web of several plies embossed in this manner because the non-uniform distribution allows partially bonding the plies to one another. Greater flexibility is obtained as a result.

In addition, cumulative perception sets in on account of the pattern's distribution rate. Softness is improved because of the unembossed or only slightly (partially) embossed surface of the cell of which the size nevertheless is adequate to carry out calendering at the time of embossing.

Calendering arises from the action by the rubber of the mating cylinder on the web when this rubber presses against the inter-tooth cylinder surface. Calendering makes the web smoother by eliminating roughness. As a result, the perception of softness is increased. Softness is enhanced further if the calendered zone is substantial enough to be felt when touching it. Therefore, the solution of the invention advantageously provides that the portions of the calendared surface are at least 1 $cm^2$. This magnitude corresponds to the contact surface between the web and the fingers.

In another feature of the invention, the first protrusions are distributed along at least three lines when the cells are adjacent. If there are fewer lines, preferential rupture paths may form.

In another feature of the invention, the lines are wavy. In this manner, the danger of forming low strength paths is reduced.

In another feature of the invention, the web includes second protrusions inside the cells. In this case, these are isolated protrusions. In other words, the protrusions are configured to subtend sub-cells large enough for the rubber to reach the bottom of the engraving during the embossing procedure and thus to ensure that the web is be calendered at that site. Advantageously these second protrusions are arrayed in unit lines running parallel to the cell edges. These protrusions shall never take up more than 15% of the cell surface.

In another feature of the invention, the first protrusions define at least 5 cells per segment, preferably 15 to 20. Preferably, the second protrusions among themselves, or between themselves and the first protrusions, define at most 100 sub-cells. A segment is the web portion torn off along a transversely pre-cut line, for example in a roll of toilet paper.

In another feature of the invention, the cells are not adjacent. In particular the space between the cells then may be taken up by a textured zone. This textured zone then preferably has an embossing density different from that of the first protrusions.

In another feature of the invention, the web constitutes at least one ply of a sheet of several plies. Due to this design, the cell configuration of the protrusions allows partial bonding and the making of a more flexible multiply product.

An illustrative and non-limiting embodiment of the invention is elucidated below in relation to the attached drawings.

The illustrated web is a creped cellulose cotton web having a specific surface weight between 10 and 40 $g/m^2$. The dots represent protrusions on one side and cavities on the opposite one. These protrusions were made by deforming the web between a rigid surface component, such as a cylinder, and a mating component, such as a cylinder fitted with a resilient coating, for example rubber. The rigid surface includes salients configured according to a desired pattern to be imparted to the cellulose cotton web. The shape of the embossing teeth is frustoconical and their cross-section is circular, oval or polygonal.

Figure 1:
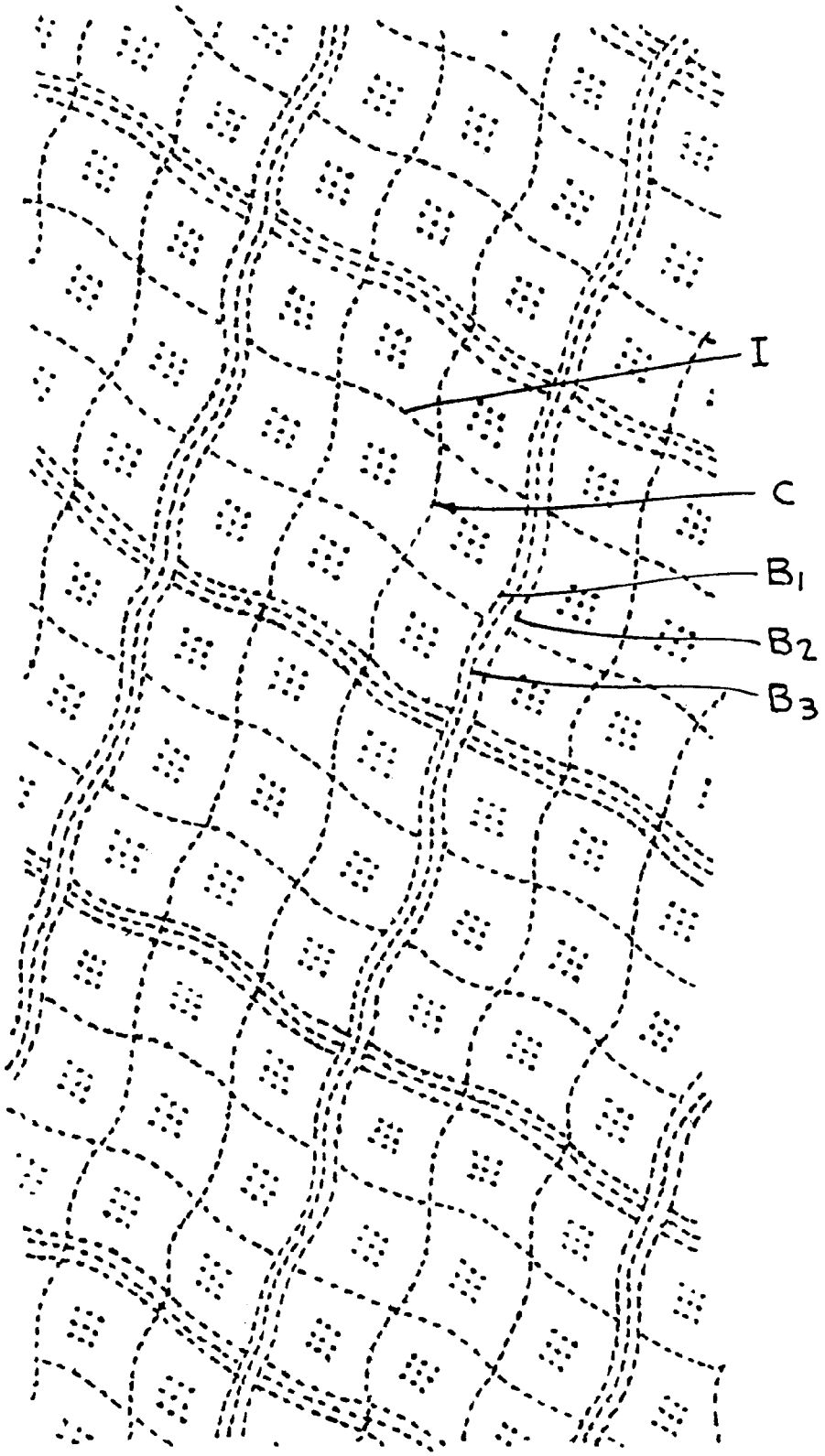
FIG. 1 is a top view of a web embossed in the manner of the invention.

The pattern shown in FIG. 1 is composed of juxtaposed cells bounded by multiple rows configured in a crossing manner. Illustratively, the diamond-shaped cell C is defined by triple protrusion rows $B_1$, $B_2$, $B_3$. These rows are slightly wavy.

In the invention, the first protrusions are configured so that the local density of the first protrusions are larger than 30/$cm^2$. Preferably it is larger than 60/$cm^2$.

Their surface at the top is less than 1 $mm^2$. To reach the goal of the invention, namely mechanical strength and thickness equivalent to those of a web embossed uniformly across the full surface and having a density of the same order, the number of rows or lines is at least three when they bound adjacent cells.

The inside of the cell C is unembossed or else includes unembossed zones bounded by isolated second protrusions I. This designation applies to protrusions subtending between themselves or between them and the cell edges so-called sub-cell zones where the web is calendered. This calendering is possible only if there is sufficient free space to allow the resilient material of the mating part to press against the base surface between the teeth. In the embodiment shown, these isolated protrusions subtend lines running parallel to the cell edges and dividing the cells into nine sub-cells.

Tests were run to compare the behavior of a web of the invention with that of a web of the prior art. The Table below lists the means used and the results.

The prior art pattern consists of uniformly distributed protrusions configured, for example, in rows running substantially in the direction of advance and one row staggered relative to the next, the density being 80 protrusions/$cm^2$. The surface at the top of the embossing teeth is 4.4 $mm^2$. The pattern takes up 100% of the surface.

The pattern of the tested invention is that of FIG. 1. The average number of protrusions is 25/$cm^2$. However, the density rises to 60/$cm^2$ in the zones $B_1$, $B_2$ and $B_3$ forming the edges. The protrusions take up 20% of the web surface. In other words, the sub-cells take up 80% of the surface.

TABLE

| | Prior-art Pattern | Pattern of the Figure |
|---|---|---|
| Mean density | 80 Teeth/$cm^2$ | 25 Teeth/$cm^2$ |
| Local density | 80 Teeth/$cm^2$ | 60 Teeth/$cm^2$ |
| Tooth diameter | 0.4 mm | 0.4 mm |
| % embossed surface | 100% | 20% |

| Impression (mm) | Thickness (mm)/strength (N/m) | Thickness (mm)/strength (N/m) |
|---|---|---|
| 0 | 0.21/100 | 0.21/100 |
| 15 | 0.33/75 | 0.37/74 |
| 19 | 0.49/51 | 0.45/64 |
| 22 | | 0.52/51 |

Figure 2:
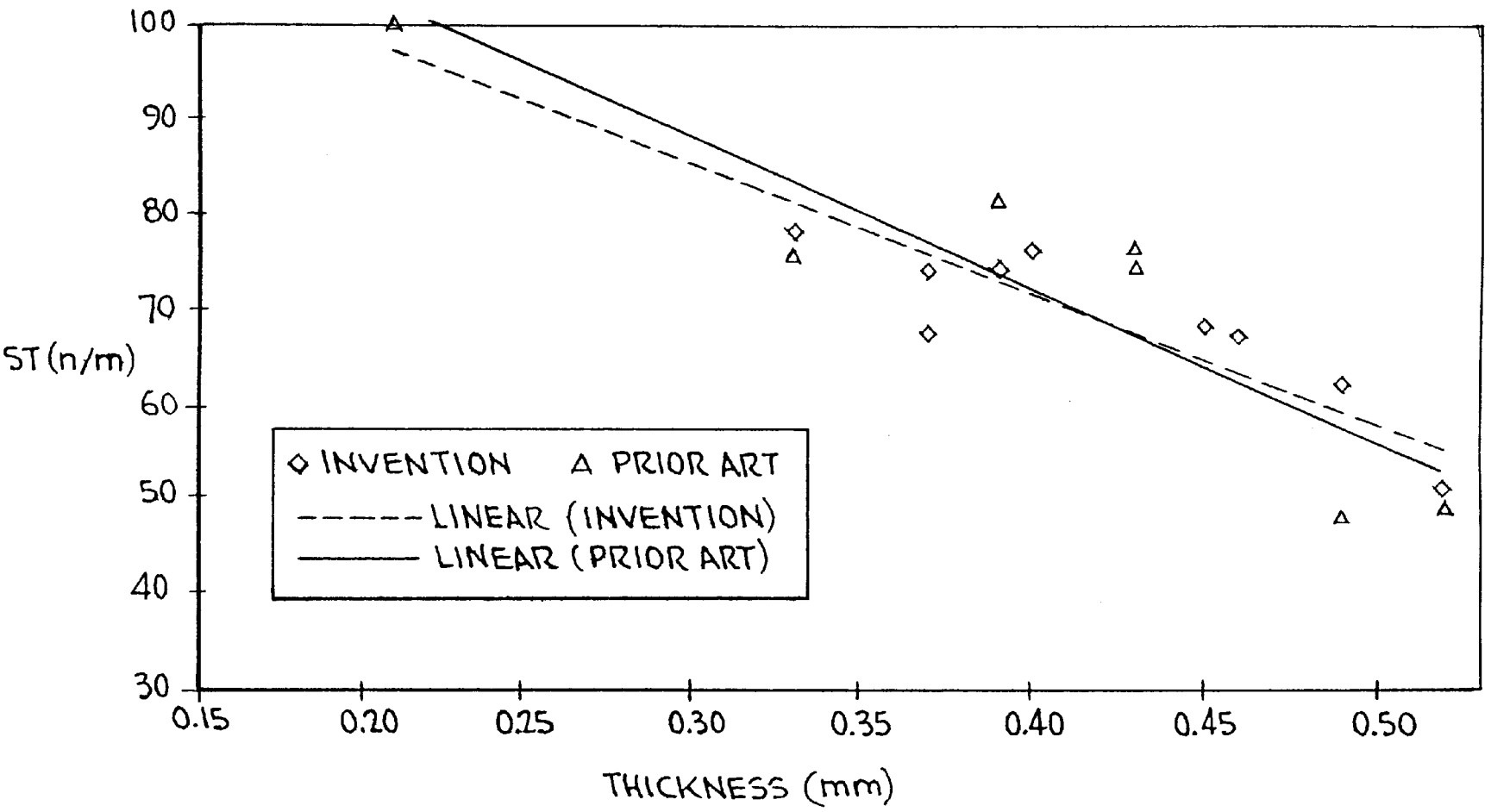
FIG. 2 is a plot of the relation between mechanical strength and thickness for a product of the prior art and a product of the invention.

Teeth of the same geometry and of the same size were used for the two patterns. The impression is the size of the rigid cylinder mark on the rubber cylinder. The impression is more pronounced the higher the applied pressure when the rubber quality is constant. Accordingly, the impression is wider the higher the pressure. The zero value of the impression denotes the web characteristics before embossing. By plotting the values in FIG. 2 showing the web's mechanical tear strength as a function of thickness, and by drawing a linear regression line between the found values, the pattern of the invention is shown to offer characteristics equivalent to those of a prior art pattern.

Accordingly, without trading away the desired features of high density embossing, a more flexible product is achieved. It is understood that a ply embossed with the claimed pattern can be combined with an identical or different ply of the prior art to make a comparatively flexible web on account of the scarce number of bonding sites.

What is claimed is:

1. An absorbent cellulosic web comprising a first side having first protrusions, each first protrusion having a top surface less than 1 $mm^2$, and said first protrusions corresponding to cavities on a second side of said web, wherein said first protrusions are distributed at a rate of more than $30/cm^2$ along mutually parallel lines in such a manner as to bound cells, said cells taking up a total surface of the web of at least 30%, said cells being unembossed or only partially embossed.

2. Web as claimed in claim 1 wherein the total surface of the cells takes up a total surface of the web of at least 50%.

3. Web as claimed in claim 1 wherein the first protrusions are distributed along at least three lines between two adjacent cells.

4. Web as claimed in one claim 1 wherein the mutually parallel lines are wavy.

5. Web as claimed in claim 1 further comprising isolated second protrusions bounding sub-cells within the cells.

6. Web as claimed in claim 1 wherein the absorbent web is formed of multiple segments and first protrusions define at least 5 cells per segment.

7. Web as claimed in claim 6 wherein the first protrusions define from 15 to 20 cells per segment.

8. Web as claimed in claim 5 wherein the second protrusions define in themselves or between themselves and the first protrusions no more than 100 sub-cells.

9. Web as claimed in claim 1 wherein the cells are not adjacent to each other.

10. Web as claimed in claim 9 wherein space between the cells has a texture with a density different from texture defining the cells.

11. Web as claimed in claim 1 wherein the web constitutes at least one ply of a multi-ply sheet.

* * * * *